US005873960A

United States Patent [19]

Kondo et al.

[11] Patent Number: 5,873,960

[45] Date of Patent: Feb. 23, 1999

[54] METHOD AND FACILITY FOR MANUFACTURING SEAMLESS STEEL PIPE

[75] Inventors: Kunio Kondo, Sanda; Yasutaka Okada, Nara; Seiji Tanimoto, Kainan, all of Japan

[73] Assignee: Sumitomo Metal Industries, Ltd., Osaka, Japan

[21] Appl. No.: 809,641

[22] Filed: Mar. 26, 1997

[30] Foreign Application Priority Data

Oct. 20, 1994 [JP] Japan ..... 6-255217

[51] Int. Cl.[6] ..... B21B 23/00; C21D 8/06

[52] U.S. Cl. ..... 148/593; 148/541; 164/415; 164/417; 164/477; 266/142

[58] Field of Search ..... 148/593, 541; 164/417, 476, 477; 266/142

[56] References Cited

U.S. PATENT DOCUMENTS 5,186,769 2/1993 Hunt et al. ..... 148/593

FOREIGN PATENT DOCUMENTS

| | | | |
|---|---|---|---|
| 56-3626 | 1/1981 | Japan . | |
| 56-166324 | 12/1981 | Japan . | |
| 57-63633 | 4/1982 | Japan . | |
| 58-91123 | 5/1983 | Japan . | |
| 58-104120 | 6/1983 | Japan . | |
| 58-117832 | 7/1983 | Japan . | |
| 58-120720 | 7/1983 | Japan . | |
| 58-224116 | 12/1983 | Japan . | |
| 59-20423 | 2/1984 | Japan . | |
| 60-33312 | 2/1985 | Japan . | |
| 60-75523 | 4/1985 | Japan . | |
| 62-151523 | 7/1987 | Japan . | |
| 63-11621 | 1/1988 | Japan . | |
| 63-157705 | 6/1988 | Japan . | |
| 63-281705 | 11/1988 | Japan . | |
| 64-31934 | 2/1989 | Japan | 148/593 |
| 2-34752 | 2/1990 | Japan . | |
| 2-50913 | 2/1990 | Japan | 148/593 |
| 4-107213 | 4/1992 | Japan . | |
| 4-358023 | 12/1992 | Japan . | |
| 5-202417 | 8/1993 | Japan . | |
| 6-17258 | 6/1994 | Japan . | |

OTHER PUBLICATIONS

"Direct Quenching Process in Seamless Tube Manufacturing", by Yutaka Mihara et al., *Iron and Steel,* vol. 71, No. 8 (1985), pp. 965–971.

*Primary Examiner*—Deborah Yee

*Attorney, Agent, or Firm*—Burns, Doane, Swecker & Mathis, LLP

[57] ABSTRACT

The manufacturing method of the present invention comprises steps (1) through (8) which are sequentially arranged, and the steps or equipment from the production of billets to end products are connected in the same single continuous manufacturing line:

(1) a step of producing a round billet by continuous casting, (2) a step of cooling the billet to a temperature not higher than an $A_{r1}$ transformation temperature, (3) a step of heating the billet to a temperature which allows piercing of the billet, (4) a step of piercing, at a strain rate of not higher than 200/sec, the billet to obtain a hollow shell, (5) a step to form a steel pipe by elongating and finish rolling the hollow shell using a continuous elongating mill and a finish rolling mill which are directly connected to each other, at a predetermined average strain rate, a predetermined reduction ratio, and at a predetermined finishing temperature, (6) a step of recrystallizing the steel pipe at a temperature of not lower than an $Ar_{r3}$ transformation temperature, (7) a step of quenching the steel pipe from a temperature not lower than an $A_{r3}$ transformation temperature, and (8) a step of tempering the steel pipe.

12 Claims, 9 Drawing Sheets

Fig. 4

| Name of Steel | Chemical Composition (Weight%) | | | | | | | | | | | | Transformation Temperature(℃) | |
|---|---|---|---|---|---|---|---|---|---|---|---|---|---|---|
| | C | Si | Mn | P | S | Cr | Ni | Mo | Ti | Nb | sol.Al | N | $A_{r1}$ | $A_{r3}$ |
| A | 0.24 | 0.31 | 1.45 | 0.02 | 0.01 | 0.07 | 0.03 | 0.03 | — | — | 0.032 | .005 | 630 | 740 |
| B | 0.28 | 0.29 | 0.46 | 0.01 | .004 | 1.01 | 0.02 | 0.33 | 0.02 | 0.03 | 0.056 | .004 | 590 | 690 |

Fig. 5

| Measured Item | Name of Steel | Strain Rate (/sec) | | | | | | |
|---|---|---|---|---|---|---|---|---|
| | | 3 | 10 | 30 | 100 | 200 | 250 | 300 |
| Maximum Depth of Crack(mm) | A | 0 | 0 | 0 | 0 | 0 | 0.7 | 1.6 |
| | B | 0 | 0 | 0 | 0 | 0 | 0.5 | 1.3 |

Fig. 6A

| | Number of Test Piece | Name of Steel | Insertion Temperature of Billet into Furnace (°C) | Piercing | | Working of Mandrell Mill and Sizing Mill | | |
|---|---|---|---|---|---|---|---|---|
| | | | | Worked Ratio (%) | Strain Rate (/sec) | Worked Ratio (%) | Strain Rate (/sec) | Finished Temperature (°C) |
| Example of this Invention | 1 | A | 600 | 40 | 150 | 50 | 0.1 | 880 |
| | 2 | A | 600 | 40 | 150 | 50 | 0.2 | 900 |
| | 3 | A | 600 | 20 | 150 | 50 | 0.1 | 930 |
| | 4 | A | 600 | 40 | 150 | 50 | 0.3 | 870 |
| | 5 | A | 600 | 40 | 150 | 50 | 0.2 | 895 |
| | 6 | A | 600 | 40 | 150 | 50 | 0.1 | 900 |
| | 7 | B | 550 | 40 | 150 | 50 | 0.1 | 890 |
| | 8 | B | 300 | 40 | 150 | 50 | 0.1 | 880 |
| | 9 | B | 550 | 40 | 100 | 50 | 0.1 | 850 |
| | 10 | B | 550 | 40 | 150 | 15 | 0.1 | 885 |
| | 11 | B | 550 | 40 | 150 | 30 | 0.1 | 910 |
| | 12 | B | 550 | 40 | 150 | 50 | 0.05 | 950 |
| | 13 | B | 550 | 40 | 150 | 50 | 0.8 | 860 |
| | 14 | B | 550 | 40 | 60 | 50 | 0.1 | 900 |
| | 15 | B | 550 | 40 | 150 | 50 | 0.2 | 930 |
| | 16 | B | 550 | 40 | 150 | 40 | 0.1 | 860 |
| | 17 | B | 550 | 40 | 150 | 50 | 0.1 | 905 |
| | 18 | B | 550 | 40 | 150 | 60 | 0.3 | 1030 |

Fig. 6B

| | Number of Test Piece | Name of Steel | Insertion Temperature of Billet into Furnace (°C) | Piercing | | Working of Mandrell Mill and Sizing Mill | | |
|---|---|---|---|---|---|---|---|---|
| | | | | Worked Ratio (%) | Strain Rate (/sec) | Worked Ratio (%) | Strain Rate (/sec) | Finished Temperature (°C) |
| Example of Comparing Art | 19 | A | 600 | 40 | 150 | 5* | 0.005* | 925 |
| | 20 | A | 600 | 40 | 150 | 50 | 0.2 | 1060* |
| | 21 | A | 600 | 40 | 150 | 50 | 0.2 | 960 |
| | 22 | B | 550 | 40 | 150 | 5* | 0.005* | 885 |
| | 23 | B | 550 | 40 | 150 | 55 | 0.2 | 1080* |
| | 24 | B | 550 | 40 | 150 | 50 | 0.1 | 870 |
| Example of Prior Art | 25 | A | room temp. | 40 | 220 | 50# | - | 950 |
| | 26 | B | room temp. | 40 | 220 | 50# | - | 950 |

*mark: Showing the condition out of the range of this invention.
#mark: Showing the working simulations of elongating and finish rolling were not performed continuously.

Fig. 7A

| | Number of Test Piece | Cooling Rate (°C/sec) | Holding of Pipes | | Heating of Pipes | | Quenching Temperature (°C) | | Tempering Temperature (°C) |
|---|---|---|---|---|---|---|---|---|---|
| | | | Temperature (°C) | Time (sec) | Temperature (°C) | Time (sec) | Not Cooled Before Quenching | Cooled Before Quench | |
| Example of this Invention | 1 | 0.4 | - | - | - | - | 860 | - | 600 |
| | 2 | 0.2 | - | - | - | - | 890 | - | 600 |
| | 3 | - | 930 | 45 | - | - | 910 | - | 600 |
| | 4 | - | 870 | 600 | - | - | 865 | - | 600 |
| | 5 | - | - | - | 950 | 20 | 930 | - | 600 |
| | 6 | - | - | - | 870 | 300 | 865 | - | 600 |
| | 7 | 0.2 | - | - | - | - | 880 | - | 720 |
| | 8 | 0.2 | - | - | - | - | 870 | - | 720 |
| | 9 | 0.1 | - | - | - | - | 845 | - | 720 |
| | 10 | 0.3 | - | - | - | - | 880 | - | 720 |
| | 11 | 0.2 | - | - | - | - | 900 | - | 720 |
| | 12 | 0.4 | - | - | - | - | 930 | - | 720 |
| | 13 | 0.1 | - | - | - | - | 850 | - | 720 |
| | 14 | 0.2 | - | - | - | - | 890 | - | 720 |
| | 15 | - | 930 | 60 | - | - | 910 | - | 720 |
| | 16 | - | 860 | 1200 | - | - | 855 | - | 720 |
| | 17 | - | - | - | 970 | 60 | 950 | - | 720 |
| | 18 | - | - | - | 880 | 1500 | 870 | - | 720 |

Fig. 7B

| | Number of Test Piece | Cooling Rate (°C/sec) | Holding of Pipes | | Heating of Pipes | | Quenching Temperature (°C) | | Tempering Temperature (°C) |
|---|---|---|---|---|---|---|---|---|---|
| | | | Temperature (°C) | Time (sec) | Temperature (°C) | Time (sec) | Not Cooled Before Quenching | Cooled Before Quench | |
| Example of this Invention | 19 | 0.1 | - | - | - | - | 910 | - | 600 |
| | 20 | - | 1060 | 600 | - | - | 930 | - | 600 |
| | 21 | - | - | - | 1020* | 1500 | 1000 | - | 600 |
| | 22 | 0.2 | - | - | - | - | 875 | - | 720 |
| | 23 | - | 1080 | 600 | - | - | 930 | - | 720 |
| | 24 | - | - | - | 1020* | 1500 | 1000 | - | 720 |
| Example of Prior Art | 25 | - | - | - | - | - | - | 890 | 580 |
| | 26 | - | - | - | - | - | - | 940 | 690 |

* mark: Showing the condition out of the range of this invention.

Fig. 8A

| | Number of Test Piece | Proof Stress ($kgf/mm^2$) | Tensile Strength ($kgf/mm^2$) | Transition Temperature (vTrs) (°C) | Grain Size Number of Prior Austenite Grain | Value of Sc |
|---|---|---|---|---|---|---|
| Example of this Invention | 1 | 77.1 | 81.8 | -90 | 4.5 | 8.5 |
| | 2 | 75.6 | 81.6 | -78 | 4.5 | 8.5 |
| | 3 | 77.6 | 84.2 | -70 | 5 | 9 |
| | 4 | 76.6 | 84.8 | -71 | 4.5 | 8.5 |
| | 5 | 75.8 | 84.9 | -86 | 4.5 | 8 |
| | 6 | 77.1 | 83.2 | -86 | 5 | 9 |
| | 7 | 78.6 | 84.4 | -75 | 7.5 | 11.5 |
| | 8 | 75.7 | 83.8 | -68 | 7.5 | 11.5 |
| | 9 | 79.4 | 82.7 | -76 | 7 | 11 |
| | 10 | 78.8 | 85.0 | -74 | 7.5 | 12 |
| | 11 | 78.4 | 85.3 | -88 | 7 | 11.5 |
| | 12 | 79.1 | 83.6 | -67 | 7 | 11 |
| | 13 | 76.2 | 85.3 | -64 | 7 | 12 |
| | 14 | 79.5 | 85.0 | -66 | 7.5 | 12 |
| | 15 | 78.3 | 84.7 | -73 | 7 | 12 |
| | 16 | 77.0 | 83.1 | -92 | 6.5 | 11.5 |
| | 17 | 79.3 | 85.5 | -67 | 7.5 | 12.5 |
| | 18 | 78.5 | 85.8 | -66 | 7 | 12 |

Fig. 8B

| | Number of Test Piece | Proof Stress ($kgf/mm^2$) | Tensile Strength ($kgf/mm^2$) | Transition Temperature (vTrs) (°C) | Grain Size Number of Prior Austenite Grain | Value of Sc |
|---|---|---|---|---|---|---|
| Example of Comparing Art | 19 | 75.5 | 84.2 | -48 | 3.5 | 6 |
| | 20 | 75.5 | 82.9 | -44 | 3 | 6.5 |
| | 21 | 78.6 | 82.7 | -39 | 3 | 5.5 |
| | 22 | 76.5 | 85.0 | -48 | 5 | 7.5 |
| | 23 | 75.9 | 83.9 | -44 | 5.5 | 7 |
| | 24 | 76.7 | 83.1 | -34 | 5 | 7.5 |
| Example of Prior Art | 25 | 78.5 | 85.8 | -76 | 4.5 | 8 |
| | 26 | 79.9 | 84.3 | -74 | 6.5 | 11.5 |

METHOD AND FACILITY FOR MANUFACTURING SEAMLESS STEEL PIPE

TECHNICAL FIELD

The present invention relates to a method of manufacturing seamless steel pipe and to a facility used for performing the method. More particularly, the invention relates to a method and facility for manufacturing seamless steel pipe having excellent strength, toughness, and corrosion resistance using simple and continuous manufacturing process and equipment, thereby efficiently obtaining seamless steel pipe at reduced cost.

BACKGROUND ART

Oil country tubular goods, line pipes, heat exchanger tubes, general pipes, and pipes for bearing rings, are usually made of seamless steel pipe. Seamless steel pipe used for such purposes is typically made of carbon steel, low alloy steels containing alloy components such as Cr and Mo, and high Cr stainless steels. Seamless steel pipe is usually manufactured by the Mannesman-mandrel mill method. However, this method is often very complicated because, for example, severe hot working is performed by a piercer and a high level of properties is required of the resulting products.

FIG. 1 shows an example of a manufacturing process employing a Mannesman-mandrel mill method. There are a number of steps in forming a starting steel ingot into a pipe product. The material being processed undergoes various types of working, heating, and cooling in a repeated manner. The broken line in FIG. 1 indicates changes of lines which entails transfer of materials between steps and processing such as temporary stocking. In a manufacturing process employing a Mannesman-mandrel mill method, a lot of process lines are employed, requiring many types of equipment having advanced functions and consuming a large amount of energy. This results in an unavoidable increase in costs.

In order to reduce manufacturing costs, it is necessary to enhance productivity, to cut equipment costs, and to reduce operating costs. More specifically, in the manufacture of seamless steel pipe, it is desired to simplify manufacturing steps and equipment and to obtain products having properties superior to conventional ones.

To this end, a variety of techniques have been developed for the manufacture of seamless steel pipe. Particularly, many proposals have been made concerning forming a billet from a steel ingot, hot piercing, elongating, finish rolling, and subsequent heat treatment for providing predetermined properties to the product after finish rolling.

With respect to the step of making a billet having a round cross section from a steel ingot, there is proposed an approach in which a round billet is produced by continuous casting so as to avoid blooming or forging. For example, Japanese Patent Application Laid-open (kokai) No. 63-157705 discloses a method for manufacturing a seamless steel pipe in which a billet having a round cross section is pierced and then elongated. In the method disclosed in this publication, however, technical problems with respect to heating conditions for billet piercing and piercing conditions of a piercer (i.e., a skew-roll piercing mill) are not sufficiently solved. Therefore, a material pierced according to this method tends to generate cracks during piercing.

Also, from the viewpoint of performing process steps in a continuous manner, "Iron and Steel" vol. 71 (1985) No. 8, pp.965–971 discloses a manufacturing facility in which a mandrel mill (which is a continuous elongating mill) and a sizer (which is a finish rolling mill) are directly connected. The reason for directly connecting a continuous elongating mill and a finish rolling mill as given in this publication is only to secure a quenching temperature. As a natural consequence, the material which has undergone finish rolling is subjected to quenching while it still is at a high temperature, resulting in coarsening of grains and a reduction in toughness of the resulting pipe product.

Many improvements have been proposed with respect to the heat treatment step for imparting to the material predetermined properties which must be possessed by final products. Seamless steel pipe is required to have highly reliable quality and excellent properties. Therefore, as shown in FIG. 1, heat treatment, including quenching and tempering which are critical to the product quality, is normally performed off-line because this enables strict line control. That is, a quenching apparatus and a tempering furnace are normally provided independently of the pipe-forming line. Such off-line processing hampers simplification of manufacturing facilities and reductions in energy consumption.

To solve this problem, there has been an attempt in recent manufacture of seamless steel pipe to perform on-line quenching by a so-called direct quenching method exploiting heat of a pipe which has undergone finish rolling. The direct quenching method is advantageous in that it renders off-line quenching equipment unnecessary and simplifies manufacturing steps, achieving a considerable reduction in costs.

For example, Japanese Patent Application Laid-open (kokai) Nos. 56-166324, 58-120720, 58-224116, 56-020423, 60-033312, 60-075523, and 62-151523 disclose a method for manufacturing seamless steel pipe including direct quenching in which steel pipe is forcibly cooled immediately after it passes a finish rolling step. Unfortunately, products obtained through a process including direct quenching do not have as good quality as those obtained through a process in which off-line quenching is performed. In other words, grain in microstructure is coarser than those obtained through conventional processes, and therefore, toughness and corrosion resistance are inferior.

In order to refine grain, an on-line thermomechanical treatment has been proposed. For example, Japanese Patent Application Laid-open (kokai) No. 56-003626 discloses a method in which a cooling step and a reheating step are incorporated between elongating and finish rolling. Japanese Patent Application Laid-open (kokai) Nos. 58-091123, 58-104120, 63-011621, and 04-358023 disclose a method in which a treatment combining cooling and reheating is performed after finish rolling. Japanese Patent Application Laid-open (kokai) No. 58-117832 discloses a method in which cooling and reheating are performed twice, the first time being in the course of rolling (between elongation and finish rolling), and the second time being after finish rolling. Any of these methods employs an on-line combination of cooling and reheating and features a total of two or more iterations of transformation from austenite to ferrite and transformation from ferrite to austenite.

Any of the above methods requires that a pipe material to be processed be forcibly cooled to a temperature range in which transformation commences or is completed and be subsequently reheated to a temperature range in which austenitization is completed. Thus, these methods consume large amounts of energy, causing high energy costs. In addition, they require complicated manufacturing equipment, increasing construction costs for manufacturing facilities. Moreover, mechanical properties such as strength, etc. of seamless steel pipe manufactured by a direct quenching method greatly inconsistent. This is because the quenching temperature is not uniform in the longitudinal direction of a steel pipe or because the temperature differs between manufacture lots. Therefore, there are still problems to be solved in order to efficiently mass produce seamless steel pipe having a uniform quality. Thus, the above-mentioned methods require improvements in equipment costs and operating costs and also in properties of resultant products when compared with conventional methods involving off-line quenching.

In the manufacture of seamless steel pipe, if respective steps are arranged off-line in an independent manner, there arises a problem ;hat space is needed for storing billets and like materials to be processed because processing speed differs from step to step. For example, since a billet yard for storing billets to be pierced and a place for temporarily storing steel pipe before heat treatment are needed, a large area is required. Also, in order to convey materials from step to step, a number of conveyances including auxiliary means such as cranes, trucks, etc. are needed.

As described above, none of the above-described conventional methods were successful in manufacturing seamless steel pipe having excellent properties using simplified manufacturing steps and equipment with high productivity and reduced manufacturing costs.

The present invention was made to solve the above-mentioned problems, and an object of the present invention is to provide a method for manufacturing seamless steel pipe having properties superior to those of conventional products using simple manufacturing steps and equipment at reduced costs with good productivity, and a manufacturing facility for performing the method.

DISCLOSURE OF THE INVENTION

An object of the present invention is to provide a method for manufacturing seamless steel pipe having properties superior to those of conventional products using simple manufacturing process and equipment at reduced costs with good productivity, and a manufacturing facility for performing the method.

The manufacturing method of the present invention comprises the following steps 1) to 8) which are performed in series on the same manufacturing line:

1) a step of producing a billet having a round cross section by continuous casting,
2) a step of cooling the billet to a temperature not higher than an $A_{r1}$ transformation temperature,
3) a step of heating the billet cooled to a temperature of not higher than the $A_{r1}$ transformation temperature to a temperature which allows piercing of the billet,
4) a step of piercing, at a strain rate of not higher than 200/sec, the billet heated to a temperature which allows piercing of the billet so as to obtain a hollow shell,
5) a step of obtaining a steel pipe by elongating and finish rolling the hollow shell using a continuous elongating mill and a finish rolling mill which are directly connected to each other, at an average strain rate of not lower than 0.01/sec, a reduction ratio of not lower than 10%, and at a finishing temperature between 800° and 1,050° C.,
6) a step of recrystallizing the steel pipe at a temperature of not lower than an $A_{r3}$ transformation temperature,
7) a step of quenching the steel pipe obtained in step 6) from a temperature not lower than an $A_{r3}$ transformation temperature, and
8) a step of tempering the quenched steel pipe.

The manufacturing facility employing the method of the present invention includes equipment corresponding to the above steps 1) to 8), and the equipment are connected in series for continuous and sequential operation.

According to the method and facility for manufacturing seamless steel pipe of the present invention, it is possible to obtain seamless steel pipe having properties superior to those of conventional seamless steel pipe at reduced manufacturing costs with good productivity. Thus, the present invention significantly contributes to the manufacture of seamless steel pipe on an industrial scale.

BRIEF DESCRIPTION OF THE DRAWINGS

FIG. 4 is a table showing chemical compositions and transformation temperatures of test billets used in embodiments of the present invention;

FIG. 5 is a table showing the results of Test 1 in which the maximum depth of cracks was measured on hollow shells;

FIG. 6 is a table showing conditions for piercing, elongating, and finish rolling in Test 2;

FIG. 7 is a diagram showing recrystallizing conditions, quenching conditions, and tempering conditions in Test 2; and FIG. 8 is a table showing strengths, prior austenite grain sizes, and corrosion resistance of the materials obtained in Test 2.

BEST MODE FOR CARRYING OUT THE INVENTION

The inventors of the present invention conducted extensive studies in an attempt to simplify a process for manufacturing seamless steel pipe and to find optimal treatment conditions in each step of the process. Based on their new findings, they were successful in creating the following manufacturing method and facility which are free from the above-mentioned problems.

Figure 2:
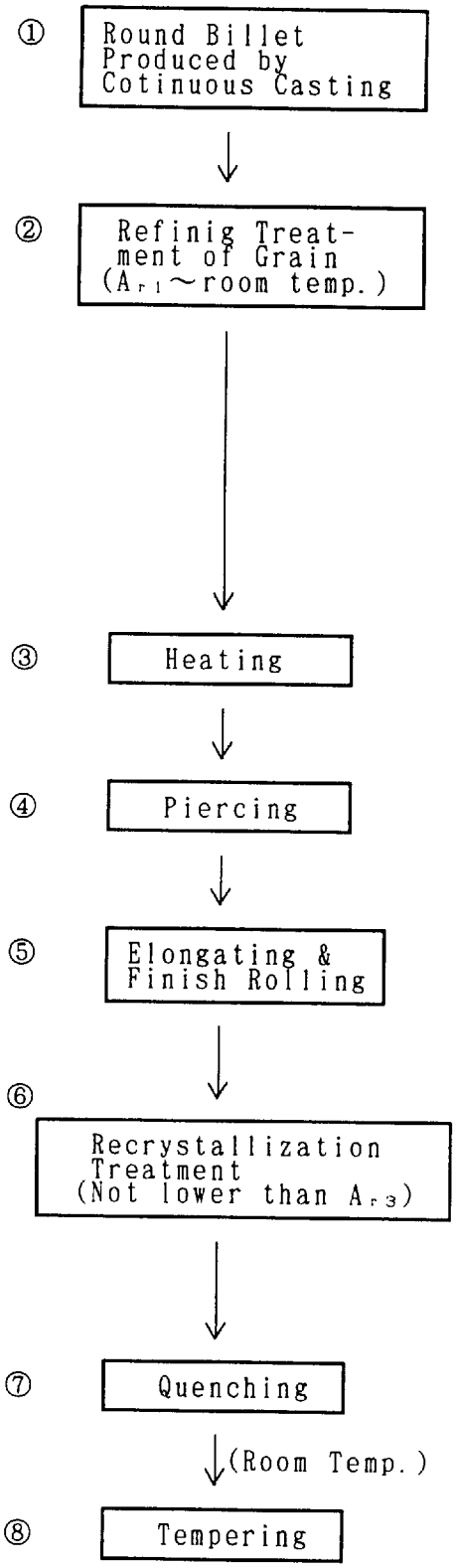
FIG. 2 is a flow diagram showing steps for manufacturing seamless steel pipe according to the present invention.

FIG. 2 shows the manufacturing process of the present invention. The present invention is based on the following ideas and technical approaches.

(1) A billet having a round cross section is produced by continuous casting. This approach eliminates blooming, rolling, and forging steps which are required when a steel ingot or a continuously cast square bloom is used.

(2) The billet which has passed through a casting step is cooled to a temperature not higher than the $A_{r1}$ transformation temperature before it is heated for piercing. By this cooling process, the grain size can be effectively reduced in the subsequent heating step. Refining of the grain size prevents cracks from generating in the billet even in a severe hot working of piercing.

(3) After the billet is cooled to a temperature not higher than the $A_{r1}$ transformation temperature, it is heated to a temperature which allows piercing. At this time, heating of the billet is preferably started from as high temperature as possible, as long as it is cooled under the $A_{r1}$ transformation temperature so as to fully utilize the heat accumulated in the casting step. By this approach, the energy required for heating the billet can be considerably reduced. Moreover, compared to methods in which steel ingots or square continuously cast blooms are used, the size of the stock yard can be greatly reduced.

(4) In piercing, a skew-roll piercing mill is used. When a billet is pierced, a properly selected strain rate is applied so as to prevent cracks from forming in the billet.

(5) In continuous elongating and finish rolling which are performed after piercing, an elongating mill and a finish rolling mill are placed in series close to each other on the equiaxial line. By this arrangement, lowering of the temperature of the material to be rolled is suppressed, and strain induced by working is effectively accumulated. This approach is effective in achieving remarkable refinement of grains in a subsequent recrystallization step.

(6) After finish rolling and before quenching, a recrystallizing treatment is applied to the steel pipe to be processed. That is, when steel pipe is transferred from a finish rolling step to a quenching step, the pipe is slowly cooled, subjected to heat-retaining, or heated to cause recrystallization. Due to accumulation of strain induced by working in the previous step and the treatment in this step, grains can be effectively refined. In this step, a heating furnace may also be used if desired so as to adjust the temperature of the steel pipe. By adjusting the temperature of steel pipe, differences in the quenching temperature in the longitudinal direction of the pipe and among manufactured lots can be minimized. Moreover, by elevating or decreasing the temperature of pipe, precipitation of carbonitrides or like substances can be controlled. As a result, the strength of a material having a certain composition can be controlled, and in addition, coarsening of recrystallized grains can be suppressed.

(7) A steel pipe which has been adjusted to have a proper range of grain sizes and a proper amount of precipitates is immediately quenched from a temperature not lower than an $A_{r3}$ transformation temperature. Note that this step does not excludes slow cooling of pipe to a temperature higher than an $A_{r3}$ transformation temperature.

(8) The pipe is then tempered in a tempering furnace provided on the same processing line.

A series of processes from (6) to (8) improves toughness, corrosion resistance, and other properties compared to conventional products.

The present invention was accomplished based on the above-described technical concepts.

Figure 3:
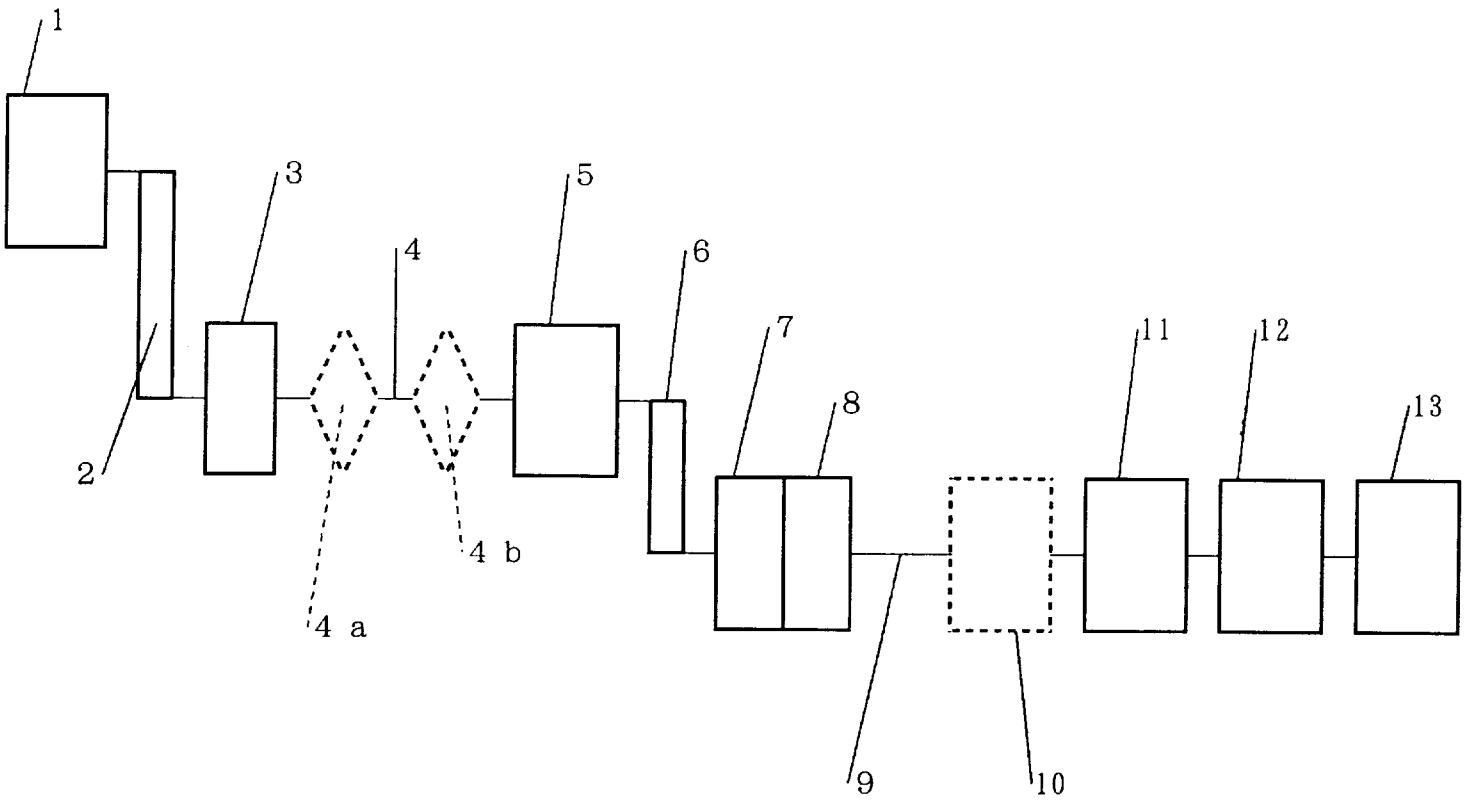
FIG. 3 is a schematic illustration showing a layout of the equipment for manufacturing seamless steel pipe according to the present invention.

FIG. 3 is a schematic drawing showing a layout of manufacturing equipment for performing the method of the present invention. While referring to FIGS. 2 and 3, the present invention will next be described in detail.

Step 1) Production of a billet

A billet having a round cross section is produced using a continuous caster equipped with a mold with a molten steel inlet having a round cross section. The inner diameter of the mold is selected depending on the outer diameter of a billet, which is determined in accordance with the outer diameter of the steel pipe to be manufactured. Thus, a billet having a prescribed outer diameter and length is continuously cast.

Numeral 1 in FIG. 3 indicates a continuous caster equipped with a mold with a molten steel inlet having a round cross section. The continuous caster has a structure that allows exchange of molds in accordance with the outer diameter of the billet to be produced. Using this continuous caster, the round billet having an outer diameter, which fits a pipe-forming schedule, is cast in a continuous fashion. On the downstream end of a billet casting section, a cutter is provided for cutting a billet after the core of the billet has been mostly or completely solidified. Also, the continuous caster may include a roll stand for applying light reduction to a billet for the purpose of reforming the metallographic structure of the cast billet, etc. In this case, the roll stand is placed on the upstream side of the billet cutter.

Step 2) Refining of a billet

The cast billet is cooled to a temperature from room temperature to the $A_{r1}$ transformation temperature. The purpose of this treatment is to provide a billet with hot workability so that it can endure heavy working applied by a skew-roll piercing mill (hereinafter referred to as a piercer) in the subsequent piercing step. In order to improve hot workability of a billet, the metallographic structure of the billet must be refined. According to the strategy of the present invention, the billet is temporarily cooled to a temperature not higher than the $A_{r1}$ transformation temperature at which transformation from the austenite phase to the ferrite phase is completed, and thereafter, the metallographic structure of the billet is refined by exploiting the heat applied for the purpose of piercing the billet. The cooling temperature at this time is preferably close to but not higher than the $A_{r1}$ transformation temperature so as to minimize the energy needed for heating the billet in the subsequent step. The lower limit of the cooling temperature, however, may be just above room temperature. For cooling the billet, the distance between the continuous caster and a downstream billet heating furnace may be suitably determined so as to permit the billet to be cooled to a temperature not higher than the $A_{r1}$ transformation temperature. Alternatively, a cooling means that forcibly cools a billet may be provided.

In FIG. 3, the equipment for performing this step comprises a transverse conveyor 2 and a billet heating furnace 3. The transverse conveyor 2 preferably has a length required for the cast billet to be cooled to a temperature not higher than the $A_{r1}$ transformation temperature. If facility layout or other conditions do not permit such a distance, the billet may be cooled by a forced cooling means placed in the conveyor 2.

Step 3) Heating of a billet

In this step, the billet is sufficiently heated and soaked in the heating furnace 3 to a temperature which allows piercing with a piercer 5 in the subsequent piercing step. The optimum temperature depends on the material, and is determined considering characteristics of the material to be pierced, including high temperature ductility and high temperature strength. The heating temperature is generally in the range between 1,100° and 1,300° C.

The billet heating furnace 3 is preferably of a type that forwards a billet in a transverse direction. Since the heating efficiency of a billet can be enhanced by elevating the billet-charging ratio in the heating furnace, the billet is preferably as long as possible. Thus, the length of the billet charged in a heating furnace is preferably a multiple of the length of the billet which undergoes piercing. In this case, the billet is cut with a cutting equipment **4*a* such as a gas cutter or a hot saw provided between the billet heating furnace 3 and the piercer 5, and the resulting billet pieces are supplied to the piercer 5. If the temperature of the billet pieces falls excessively during the cutting operation, they may be heated using the auxiliary heating apparatus 4*b*** such as a tunnel-type induction heater which is provided on the downstream side of the cutting equipment and which is capable of heating the billet in a short period of time.

Step 4) Piercing

In the present invention, a cast billet which has not been hot rolled is pierced using the piercer 5 to make a hollow shell. Since piercing is an extremely heavy working, the material which undergoes piercing tends to generate cracks when it is pierced. A countermeasure employed in the present invention for avoiding generation of cracks is a combination of refinement of the metallographic structure of the billet and piercing of the billet at a limited strain rate of not higher than 200/sec. Thus, a strain rate of not higher than 200/sec during piercing is an essential feature of the present invention.

The strain rate is defined by the following equation:

$$(S_B-S_a)/(S_B\times T)$$

Wherein, $S_B$: Cross-sectional area of material before being worked $S_A$:Cross-sectional area of material after being worked T: Time needed for working(seconds)

When the material has poor hot workability, it is preferably pierced at a temperature as high as possible. To this end, an auxiliary heater 4*b* such as the aforementioned tunnel-type induction heater is preferably provided just before the piercer 5 to elevate the temperature of the billet.

The strain rate is not more than 200/sec. There is no critical lower limit on the strain rate. However, since a strain rate of less than 0.1/sec significantly shortens the service life of tools, such as a plug and guide shoes of the piercer 5, the strain rate is preferably not less than 0.1/sec.

The piercer 5 may be of any type insofar as it is a skew-roll piercing mill. To perform the method of the present invention, a high toe angle skew-roll piercer which is capable of yielding a thin-wall pipe and realizing a high tube expansion ratio is particularly suitable. The reason for this choice is that a round billet of a single diameter suffices to produce different hollow shells having a great variety of diameters, thus decreasing the number of billet sizes required.

The temperature of a hollow shell which has passed through this piercing step is normally between 1,050° and 1,250° C., although it varies depending on the material, piercing conditions, etc.

Step 5) Elongating and finish rolling

The resulting hollow shell is conveyed by a transverse conveyor 6 to a shell inserting table of a continuous elongating mill (a mandrel mill) 7 provided at the tail end of the conveyor 6. On the table, a mandrel bar is inserted into the shell while the rear end of the mandrel bar is secured by a bar retainer. Subsequently, with a continuous elongating mill 7 and a finish rolling mill 8, the shell is elongated and finish rolled at an average strain rate of not less than 0.01/sec, a reduction ratio of not less than 10%, and a finishing temperature between 800° and 1,050° C., thereby obtaining a steel pipe having a prescribed size.

Preferably, the elongating mill is a mandrel mill which is a continuous-type elongating mill comprising a plurality of roll stands. To perform finish rolling, a sizer or a stretch reducer, both comprising a plurality of roll stands like a mandrel mill, is used. Working in this step is performed at a lower temperature relative to that in the preceding piercing step as a consequence that the material cools between the two steps. The present invention exploits this relatively low temperature for effecting a thermomechanical treatment, which makes a characteristic feature of the present invention. Thus, this is an important step in the present invention. In the present invention, a mandrel mill 7 (which is a continuous elongating mill) and a sizer 8 (which is a finish rolling mill) or a stretch reducer are not far apart from each other, but rather they are directly connected to each other. Specifically, the two mills are arranged in series on the same process line with a distance less than the length of the steel pipe elongated by a continuous elongating mill between the mills. With this arrangement, it is possible to immediately apply additional working to the pipe with a finish rolling mill before strain induced by working with the continuous elongating mill recovers. Working which meets this purpose can effectively achieve refinement of grains of steel pipe in the subsequent recrystallization step.

In more detail, even when the same pass schedule is employed, if a continuous elongating mill and a finish rolling mill are placed in an isolated manner with a great distance therebetween, grains will grow larger after the pipe has passed through a recrystallization step. In order to attain the goal of the present invention, i.e., to obtain steel pipe with an improved quality superior to conventional pipe, this feature of placing a continuous elongating mill and a finish rolling mill close to each other in series is essential.

In this step, the average strain rate (Ve) defined by the following equation (a) must not be less than 0.01/sec. If the average strain rate is less than 0.01/sec, recrystallization occurs between each pass, and therefore, accumulation of strain is hampered. Under such conditions, a later recrystallization step cannot provide a sufficient level of refinement of grains. The working ratio in this step must be not less than 10%. If the amount of strain calculated in the working ratio (reduction ratio of cross-sectional area) is less than 10%, recrystallization will not easily proceed, and thus, the desired effect of refinement of grains cannot be obtained.

The finishing temperature of the material which has undergone finish rolling is between 800° and 1,050° C. This temperature range is selected because it realizes significant refinement of grains.

Thus, in this step, the average strain rate is not less than 0.01/sec, the working ratio is not less than 10%, and the finishing temperature in a finish rolling mill is between 800° and 1,050° C.

It is not necessary to provide particular upper limits for the average strain rate and working ratio. However, since an average strain rate in excess of 10/sec significantly shortens the service life of tools, such as a mandrel bar of the mandrel mill, the average strain rate is preferably not less than 10/sec. Also, because a working ratio in excess of 95% causes considerable amounts of cracks, the working ratio is preferably not higher than 95%.

$$Ve=(Me+Se)/Mt \qquad (a)$$

wherein

Me: strain induced by the continuous elongating mill,

Se: strain induced by the finish rolling mill, and

Mt: time(sec) after the top end of a hollow shell enters the continuous elongating mill until it leaves the finish rolling mill (sec).

The mandrel mill which may be used in the present invention for continuous elongating mill may be of any type as long as it has a retainer for a mandrel bar (a bar retainer) which secures the rear end of a mandrel bar regulating the internal surface of a shell and which allows reuse of the bar by pulling the bar through a series of caliber rolls after elongating rolling is finished. Especially, it is preferred that a mandrel mill be equipped with a bar retainer capable of controlling the speed of the moving mandrel bar at a speed independent of the speed of the shell transferred by rolling during elongating rolling of the hollow shell. The finish rolling mill (a sizer or a stretch reducer) may be of any type as long as it does not use an internal regulating tool,. Particularly, it is preferred to use an extracting sizer or an extracting stretch reducer capable of extracting the shell to separate the mandrel bar enclosing the shell which has passed through a continuous elongating mill.

The conveyor 6 may be not only of a transverse type but also of a longitudinal type.

Step 6) Recrystallization

In the present invention, prior to a quenching step, a recrystallizing treatment at a temperature of not lower than the $A_{r3}$ transformation temperature is performed after elongating and finish rolling. In this step, strain induced by continuous elongating and finish rolling in the previous step is combined with annealing, heat-retaining, or heating performed in the present step to effectively produce recrystallization and to refine the grain size. The treatment effected by the combination of these two steps is unique to the present invention, and is a very effective thermomechanical treatment for improving the quality of resulting products.

Recrystallization is performed using a conveyor 9 which is placed on the downstream side of a sizer (a finish rolling mill) 8 and which is capable of cooling steel pipe slowly. Alternatively, it may be performed using a heat retaining furnace or a heating furnace, or a heat retaining/heating furnace provided on the way of the conveyor route.

(Slow Cooling Method)

The steel pipe which has passed through finish rolling is cooled slowly to a predetermined quenching temperature not lower than the $A_{r3}$ transformation temperature. In this step, it is necessary that recrystallization be completed to refine grains before quenching gets started, so slower cooling rates are preferred. If the cooling rate surpasses air cooling, coarse grains or mixed grain structures result to reduce the toughness of steel. Therefore, the cooling rate is determined than air slower rate than air cooling. Preferably, the cooling rate is not more than 0.5° C./sec.

In order to cool steel pipe slowly in this step, the conveyor 9 between the exit of the finish rolling mill and the entrance of a quenching apparatus may be enclosed with a cover lined with an insulating material such as glass wool or with a plate having a mirror surface capable of reflecting radiant heat in order to avoid rapid cooling.

(Heat Retention Method)

Heat retention method is one for holding the temperature of steel pipe after undergoing finish rolling at the finishing temperature. If the holding time is less than 30 seconds, recrystallization does not occur. On the other hand, even when the temperature is held over 30 minutes, increased effects regarding recrystallization are not obtainable. Since retention for a prolonged period increases energy costs while decreasing production efficience, the retention time was determined to fall the range between 30 seconds and 30 minutes.

(Heating and Soaking Method)

A steel pipe after undergoing finish rolling is held at a temperature between 850° and 980° C. for 10 seconds to 30 minutes. If the temperature is lower than 850° C. and the holding time is less than 10 seconds, crystallization does not occur. On the other hands, if the temperature is higher than 980° C. and the holding time is in excess of 30 minutes, the grain size increases. Therefore, in the present invention, a steel pipe is held at a temperature between 850° and 980° C. for 10 seconds to 30 minutes. In this description, soaking is intended to encompass an operation in which steel pipe is soaked in a heating furnace at a temperature lower than the finishing temperature of the steel pipe in the previous step.

The above-described heat retention, heating accompanied by elevated temperature, or soaking may be performed using a heat retaining furnace, a heating furnace, and a heat-retention/heating furnace which are used commonly in this technical field. Use of these furnaces is recommended since a desired temperature of the material to be quenched can be easily obtained. In addition, such a use is advantageous in that temperature can be easily uniformed in the longitudinal direction of a steel pipe and over manufactured lots, and thus differences in the product quality can be remarkably minimized. Also, if the temperature at which steel pipe is held or to which steel pipe is heated with or without temperature elevation is set slightly higher, carbides which have been precipitated during elongation and finish rolling can be dessolved, and therefore, temper softening resistance is improved by secondary precipitation hardening. Conversely, if this temperature is set slightly lower, precipitation may be accelerated to prevent coarsening of grains by the grain boundary pinning effect.

Step 7) Quenching

After the recrystallization treatment is completed, steel pipe is conveyed to a quenching apparatus 11 by a conveyor 9. During the conveyance, the temperature of the steel pipe must not fall lower than the $A_{r3}$ transformation temperature. Thus, a finish rolling mill 8 and a quenching apparatus 11 are in-line connected via the conveyor 9 or a similar means. In the quenching apparatus 11, steel pipe at a temperature not lower than the $A_{r3}$ transformation temperature is quenched.

It is necessary that quenching be performed from a temperature not lower than the $A_{r3}$ transformation temperature at a high speed so as to provide sufficient strength and toughness to steel pipe. Even when a steel pipe having a thick wall is treated, the cooling rate must be sufficiently high. To achieve this, use of an apparatus having a structure capable of cooling both inner and outer surfaces of steel pipe simultaneously is recommended.

Step 8) Tempering

The steel pipe which has passed through quenching is transferred to a tempering furnace 12 placed adjacent to and on the downstream side of the quenching apparatus 11 on the same manufacturing line. Thus, the quenching apparatus and the tempering furnace 12 are connected within the manufacturing line via the conveyor. Steel pipe is tempered by being heated and soaked at a prescribed temperature.

Since tempering is an important process which affects the properties of the end products, it is necessary that an optimum tempering temperature be determined in accordance with the desired properties of the end product and that the steel pipe be thoroughly soaked at the thus-determined temperature. Differences in the tempering temperature must be at most +10° C., and preferably within +5° C. By this treatment, differences in the yield strength (YS) and tensile strength (TS) can be suppressed to fall within +5 kgf/mm$^2$ of the target strength.

After tempering, steel pipe is straightened with a straightener 13, and thus an end product steel pipe is obtained.

EMBODIMENTS

The manufacturing method of the present invention was performed in the following two tests.

(Test 1)

The relationship between the strain rate when a billet is pierced and occurrence of cracks in a pierced hollow shell was investigated. The test billets were formed by pouring two kinds of molten steel having compositions A and B shown in FIG. 4 into a mold having an inner diameter of 90 mm. The compositions A and B correspond to AISI 1524 and AISI 4130, respectively. After the molten steel had been solidified, billets were immediately removed from molds. The billets both were cooled to 600° C.(steel A) and 500° C.(steel B), respectively which temperatures were not higher than the $A_{r1}$ transformation temperature shown in FIG. 4. Thereafter, they were held at 1,250° C. for 1 hour in a heating furnace, after which a piercing test was performed using a piercer for experimental use, obtaining hollow shells. The hollow shells were checked in terms of occurrence of cracks and the maximum depth of the cracks.

FIG. 5 shows the measurements regarding the maximum crack depths of the hollow shells.

As is apparent from FIG. 5, neither steel A or B produced cracks in the resulting hollow shells when the strain rate during piercing was not higher than 200/sec. However, at a strain rate in excess of 200/sec, cracks were formed.

Therefore, it was confirmed that if piercing of a billet is performed in a situation where a cast billet is cooled to a temperature not higher than the $A_{r1}$ transformation temperature and is subsequently heated to a temperature that allows piercing, the strain rate during piercing must be not greater than 200/sec.

(Test 2)

The outer diameters and chemical compositions of the billets used in this test were the same as those used in Test 1. When the billets were completely solidified, they were immediately removed from molds, and were cooled to a temperature not higher than the $A_{r3}$ transformation temperature. Thereafter, they were held at 1,250° C. for 1 hour in a heating furnace, after which a hot press working test was performed under conditions shown in FIGS. 6 and 7. The hot press working test was designed to simulate piercing (working with a piercer), elongating (working with mandrel mills), and finish rolling (working with a sizer).

Figure 1:
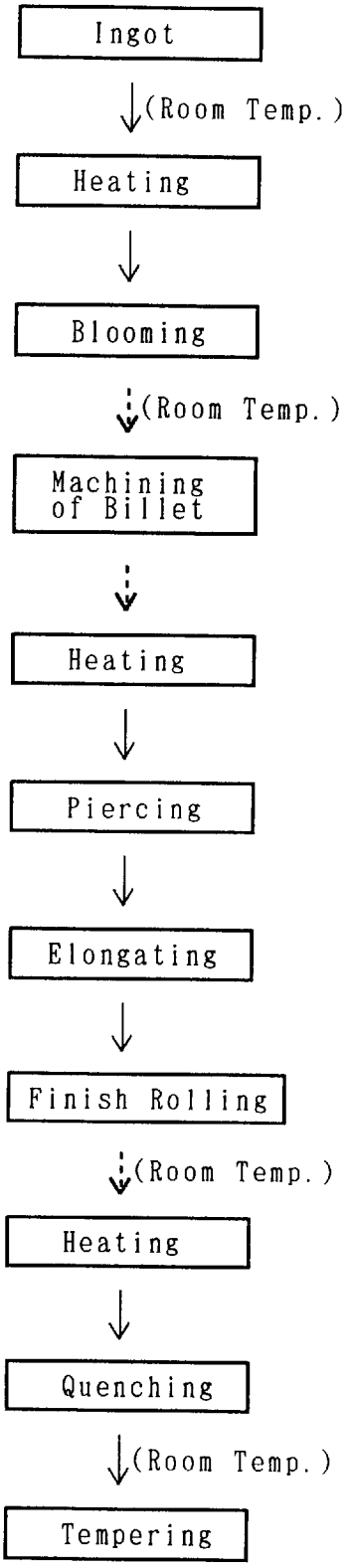
FIG. 1 is a flow diagram showing an example of a conventional process for manufacturing seamless steel pipe.

As shown in FIGS. 6 and 7, test pipe Nos. 1 through 18 indicate products of the present invention, and test pipe Nos. 19 through 24 indicate comparative products formed under manufacturing conditions outside the range of the present invention. Test pipe Nos. 25 and 26 indicate steel pipes manufactured in accordance with a conventional process shown in FIG. 1. In performing the conventional process, the strain rate of the billets during piercing was slightly greater than the range permitted by the present invention, and in addition, working simulations of elongating and finish rolling were not performed continuously. Moreover, the test pipes were cooled to room temperature between finish rolling and quenching. The test pipes of the present invention, those of comparative process, and conventional pipes were each made of two kinds of steels A and B. The cooling rate shown in FIG. 7 indicates the rate determined when test pipes which had undergone piercing and finish rolling under conditions shown in FIG. 6 were gradually cooled from the finishing temperature to a temperature not lower than the $A_{r3}$ transformation temperature. Also, in view that steels A and B would have a different strength if they are subjected to the same heat treatment and that their yield strength and toughness would not be able to compare, two different tempering temperatures were used so that comparison at almost the same strength of test pipes was made.

The test pieces after processing were investigated in terms of material strength, size of prior austenite grains, toughness (vTrs), and corrosion resistance (Sc).

The Sc values were measured in accordance with the regulations TM01-77-92, Method B provided by the NACE INTERNATIONAL. The prior austenite grain size was determined by obtaining the average length of grains which crossed a distance of 1 mm.

The results are shown in FIG. 8.

The test pipes of the present invention were first compared with test pipe Nos. 25 and 26 formed by a conventional process. In tests where steel A processed at a tempering temperature of 600° C. was used, test pipe Nos. 1 through 6 of the present invention yielded smaller grains, and exhibited toughness and corrosion resistance comparable to or more excellent than a conventional pipe (No.25). Also, in tests where steel B processed at a tempering temperature of 720° C. was used, comparison between the two groups, test pipe Nos. 7 through 18 of the present invention and test pipe No. 26 formed by a conventional process, revealed analogous results with those obtained in the case of steel A.

Test pipe Nos. 19 through 24 which represented comparative products and were manufactured under conditions outside the range of the present invention had greater grains and poor toughness and corrosion resistance relative to the test pipes manufactured according to the present invention. The reason for this outcome is that refining of grains due to working and recrystallizing was insufficient.

As is apparent from the results of the above tests, it was confirmed that the seamless steel pipe manufactured by the method of the present invention had excellent mechanical properties and corrosion resistance which were comparable to, or more excellent than, the seamless steel pipe manufactured by the conventional process.

As described above, according to the manufacturing method of the present invention, seamless steel pipe can be obtained using a simple process and simple equipment in a single manufacturing line connected from billet to product under stable manufacturing conditions. Therefore, the resulting seamless steel pipe manufactured through the method of the present invention and using the manufacturing facility of the present invention has excellent qualities comparable to or superior to conventional products. Moreover, since construction and operation costs can be reduced, costs for manufacturing seamless steel pipe can be reduced. In addition, seamless steel pipe can be effectively mass-produced. Thus, the method and facility for manufacturing seamless steel pipe according to the present invention is particularly suitable for the manufacture of seamless steel-pipe on an industrial scale.

We claim:

1. A method for manufacturing seamless steel pipe comprising the following steps 1) to 8) which are performed in series:

(1) a step of producing a billet having a round cross section by continuous casting;

(2) a step of cooling the billet to a temperature of not higher than an $A_{r1}$ transformation temperature, (3) a step of heating the billet cooled to a temperature of not higher than the $A_{r1}$ transformation temperature to a temperature which allows piercing of the billet, (4) a step of piercing, at a strain rate of not higher than 200/sec, the billet heated to a temperature which allows piercing of the billet so as to obtain a hollow shell, (5) a step of obtaining a steel pipe by elongating and finish rolling the hollow shell using a continuous elongating mill and a finish rolling mill which are directly connected to each other, at an average strain rate of not lower than 0.01/sec, a reduction ratio of not lower than 10%, and at a finishing temperature between 800° and 1,050° C., (6) a step of recrystallizing the steel pipe at a temperature of not lower than an $Ar_3$ transformation temperature, (7) a step of quenching the steel pipe obtained in step (6) from a temperature of not lower than the $A_{r3}$ transformation temperature, and (8) a step of tempering the quenched steel pipe.

2. A method for manufacturing seamless steel pipe as described in claim 1, wherein step (6) which induces recrystallization comprises cooling the steel pipe formed in step (5) to a temperature of not lower than an $A_{r3}$ transformation temperature at a cooling rate of slower than air cooling.

3. A method for manufacturing seamless steel pipe as described in claim 1, wherein step (6) which induces recrystallization comprises holding the steel pipe formed in step (5) at the finishing temperature in step (5) for 30 seconds to 30 minutes.

4. A method for manufacturing seamless steel pipe as described in claim 1, wherein step (6) which induces recrystallization comprises holding or reheating-holding the steel pipe formed in-step (5) at a temperature between 850° and 980° C. for 10 seconds to 30 minutes.

5. A method for manufacturing seamless steel pipe as described in claim 1 further comprising cooling a steel pipe which has undergone the recrystallization treatment of step (6) to a temperature of not lower than the $A_{r3}$ transformation temperature.

6. A facility for manufacturing seamless steel pipe, comprising the following equipment a) through g) which are sequentially arranged in series:

a) a continuous caster for producing a billet having a round cross section, b) a billet heating furnace for heating the billet which has been cast, c) a skew-roll piercing mill for piercing the heated billet to form a hollow shell, d) a continuous elongating mill for elongating the hollow shell, e) a finish rolling mill for finish rolling the elongated hollow shell to obtain a steel pipe having a predetermined size, f) a quenching apparatus for quenching the finish rolled steel pipe in the same manufacturing line, and g) a tempering furnace for tempering the quenched steel pipe in the same manufacturing line, under the following conditions 1) through 3):

1) the distance between the continuous caster and the billet heating furnace permits the billet to be inserted into the billet heating furnace while it is at a temperature from room temperature to the $A_{r1}$ transformation temperature but not lower than room temperature, or alternatively, a cooling means is provided capable of forcibly cooling the billet to a temperature from room temperature to the $A_{r1}$ transformation temperature, 2) the spacing between the continuous elongating mill and the finish rolling mill is shorter than the length of a steel pipe which has been elongated by the continuous elongating mill, and the continuous elongating mill and the finish rolling mill are arranged in series on the same manufacturing line, and 3) the finish rolling mill and the quenching apparatus is connected by a conveyor equipped with a means capable of cooling a steel pipe which has been finish rolled gradually at a cooling rate of slower than air cooling.

7. A facility for manufacturing seamless steel pipe comprising the following equipment a) through h) which are sequentially arranged:

a) a continuous caster for producing a billet having a round cross section, b) a billet heating furnace for heating the billet which has been cast, c) a skew-roll piercing mill for piercing the heated billet to form a hollow shell, d) a continuous elongating mill for elongating the hollow shell, e) a finish rolling mill for finish rolling an elongated hollow shell to obtain a steel pipe having a predetermined size, f) a heat-retention furnace for holding the finish rolled steel pipe at the finishing temperature or a predetermined temperature,or a heating furnace for holding the finish rolled steel pipe at a predetermined temperature after heated to the temperature, g) a quenching apparatus for quenching the finish rolled steel pipe in the same manufacturing line, and h) a tempering furnace for tempering a quenched steel pipe in the same manufacturing line, under the following conditions 1) through 3):

1) the distance between the continuous caster and the billet heating furnace permits the billet to be inserted into the billet heating furnace while it is at a temperature from room temperature to the $A_{r1}$ transformation temperature, or alternatively, a cooling means is provided capable of forcibly cooling the-billet to a temperature from room temperature to the $A_{r1}$ transformation temperature, 2) the spacing between the continuous elongating mill and the finish rolling mill is shorter than the length of a steel pipe which has been elongated by the continuous elongating mill, and the continuous elongating mill and the finish rolling mill are arranged in series on the same manufacturing line, and 3) the finish rolling mill and the quenching apparatus is connected by a conveyor equipped with a heat-retention furnace for holding the finish rolled steel pipe at the finishing temperature or a predetermined temperature,or a heating furnace for holding the finish rolled steel pipe at a predetermined temperature after heated to the temperature.

8. A facility for manufacturing seamless steel pipe as described in claim 6, wherein the skew-roll piercing mill and the billet heating furnace is connected with a conveyor equipped with billet cutting equipment for cutting a billet heated to a temperature that permits piercing of the billet.

9. A facility for manufacturing seamless steel pipe as described in claim 7, wherein the skew-roll piercing mill and the billet heating furnace is connected with a conveyor equipped with billet cutting equipment for cutting a billet heated to a temperature that permits piercing of the billet.

10. A facility for manufacturing seamless steel pipe as described in claim 6, wherein billet reheating equipment is provided between the billet cutting equipment and the skew-roll piercing mill.

11. A facility for manufacturing seamless steel pipe as described in claim 7, wherein billet reheating equipment is provided between the billet cutting equipment and the skew-roll piercing mill.

12. A facility for manufacturing seamless steel pipe as described in claim 8, wherein billet reheating equipment is provided between the billet cutting equipment and the skew-roll piercing mill.

* * * * *